US011336035B2

(12) United States Patent
Ramm

(10) Patent No.: US 11,336,035 B2
(45) Date of Patent: May 17, 2022

(54) CLAMPING SPRING FOR A SCREWLESS CONNECTION TERMINAL

(71) Applicant: Bals Elektrotechnik GmbH & Co. KG, Kirchhundem-Albaum (DE)

(72) Inventor: Andreas Ramm, Kirchhunden (DE)

(73) Assignee: Bals Elektrotechnik GmbH & Co. KG, Kirchhundem-Albaum (DE)

( * ) Notice: Subject to any disclaimer, the term of this patent is extended or adjusted under 35 U.S.C. 154(b) by 0 days.

(21) Appl. No.: 17/289,604

(22) PCT Filed: Oct. 30, 2019

(86) PCT No.: PCT/EP2019/079609
§ 371 (c)(1),
(2) Date: Apr. 28, 2021

(87) PCT Pub. No.: WO2020/089277
PCT Pub. Date: May 7, 2020

(65) Prior Publication Data

US 2021/0376497 A1 Dec. 2, 2021

(30) Foreign Application Priority Data

Oct. 31, 2018 (DE) ..... 102018127284.7

(51) Int. Cl.
*H01R 4/48* (2006.01)

(52) U.S. Cl.
CPC ..... *H01R 4/48* (2013.01)

(58) Field of Classification Search
CPC ..... H01R 4/48; H01R 4/28; H01R 4/4827; H01R 4/4818; H01R 4/4836
(Continued)

(56) References Cited

U.S. PATENT DOCUMENTS 4,768,981 A * 9/1988 Hohorst ..... H01R 4/4845 439/828
7,607,956 B2 * 10/2009 Lang ..... H01R 4/4827 439/728
(Continued)

FOREIGN PATENT DOCUMENTS

CN 102447182 A 5/2012
DE 19753078 A1 6/1999
(Continued)

OTHER PUBLICATIONS

Authorized Officer: Gomes Sirenkov E M., Official English translation of the International Preliminary Report on Patentability issued in counterpart PCT application No. PCT/EP2019/079609, dated Dec. 18, 2020, 8 pp.
(Continued)

*Primary Examiner* — Harshad G Patel
(74) *Attorney, Agent, or Firm* — Kaplan Breyer Schwarz, LLP

(57) ABSTRACT

A clamping spring for a screwless connection terminal for clamping a conductor, has a clamping limb, a contact limb, and a tensioning limb, the tensioning limb being connected to the clamping limb and the contact limb, and the clamping limb and the contact limb being designed as intersecting limbs. In the clamping limb, a clamping opening is provided, through which the contact limb extends, such that the contact limb is in contact with an edge of the clamping opening remote from the tensioning limb in a pretensioned manner and an exposed wire end of a conductor can be clamped with the contact limb onto a contact surface of a contact element of a screwless connection terminal. Furthermore, the clamping limb has a clamping extension having a clamping surface. The clamping extension, starting from the free end of the clamping limb remote from the tensioning limb, initially extends away from the tensioning limb, then
(Continued)

extends back in the direction of the tensioning limb in a substantially curved form, and finally is oriented in the direction of the contact limb.

11 Claims, 5 Drawing Sheets

(58) Field of Classification Search
USPC ..... 439/816
See application file for complete search history.

(56) References Cited

U.S. PATENT DOCUMENTS

| | | | | |
|---|---|---|---|---|
| 9,373,899 | B2 * | 6/2016 | Wu | H01R 4/4818 |
| 10,014,596 | B2 * | 7/2018 | Hartmann | H01R 4/4836 |
| 2006/0063419 | A1 * | 3/2006 | Steinkemper | H01R 4/4827 439/441 |
| 2006/0063420 | A1 * | 3/2006 | Reibke | H01R 4/4827 439/441 |
| 2008/0096441 | A1 * | 4/2008 | Eppe | H01R 9/26 439/816 |
| 2010/0081246 | A1 * | 4/2010 | Shin | H01L 29/6659 438/303 |
| 2010/0081316 | A1 * | 4/2010 | Eppe | H01H 71/08 439/441 |
| 2012/0088415 | A1 * | 4/2012 | Ramm | H01R 13/111 439/816 |
| 2014/0227914 | A1 * | 8/2014 | Tedeschi | H01R 4/4836 439/816 |
| 2016/0248174 | A1 * | 8/2016 | Ludewig | H01R 9/223 |

FOREIGN PATENT DOCUMENTS

| | | | |
|---|---|---|---|
| DE | 19831851 | C1 | 2/2000 |
| DE | 19916755 | A1 | 10/2000 |
| DE | 10034589 | A1 | 1/2002 |
| DE | 202004000418 | U1 | 6/2005 |
| DE | 202009008692 | U1 | 1/2010 |
| DE | 202011103484 | U1 | 12/2012 |
| EP | 2442403 | A1 | 4/2012 |

OTHER PUBLICATIONS

Authorized Officer: Gomes Sirenkov E M., International Preliminary Report on Patentability issued in counterpart PCT application No. PCT/EP2019/079609, dated Dec. 18, 2020, 41 pp. with translation.

Search Report issued in corresponding German patent application No. 102018127284.7, dated Jul. 3, 2019, 13 pp. w/ translation.

Authorized Officer: Gomes Sirenkov E M., International Search Report issued in corresponding PCT application No. PCT/EP2019/079609, dated Jan. 29, 2020, 12 pp.

* cited by examiner

CLAMPING SPRING FOR A SCREWLESS CONNECTION TERMINAL

FIELD

The present invention relates to a clamping spring for a screwless connection terminal for clamping a conductor, in particular for an electrical connector device.

BACKGROUND

Clamping springs for screwless connection terminals, often also in the form of cage tension springs, are known to have the advantage that a conductor to be electrically connected can be mounted without the use of screwing means. As the name suggests, clamping springs have the function of clamping the wire ends of a conductor to be connected—which can basically also be a single or multi-wire power cable with a stranded wire, a solid wire, or a conductor inserted into a wire end sleeve—to a contact element. Automatic adaptation to the respective cross section of the conductor takes place, so that one and the same connection terminal can advantageously be used for flexible lines and cables of different dimensions and designs. Connection terminals having clamping springs of the type described are used, among other things, in electrical connector systems designed for three-phase and/or alternating current, which consist of a plug part and a coupling part or a wall socket, for example device plugs, flange device plugs, surface-mounted device plugs, add-on sockets and plug-in sockets, the requirements of which are also specified in the IEC standards 60309-1,-2 and EN 60309-1,-2.

EP 2 442 403 A1 of the applicant discloses a screwless connection terminal having a contact element and a clamping spring, preferably designed as a cage tension spring, which is mounted in a pretensioned manner thereon. The contact element comprises a connection portion having an electrical contact surface for establishing electrical contact with the conductor to be connected, and the clamping spring ensures that the conductor is clamped to the contact surface of the contact element and thus that the conductor is fixed. In the preferred embodiment as a cage tension spring, the clamping spring has a contact limb, a clamping limb, and a tensioning limb which connects the contact limb to the clamping limb. The clamping limb has a clamping opening, through which the wire ends of the conductor are guided to the clamping attachment and the contact limb protrudes in an intersecting manner. In addition, the clamping limb has a conductor clamping extension with a clamping surface that is oriented substantially parallel to the contact surface of the contact element. The conductor to be connected should be clamped between a surface portion of the clamping surface of the conductor clamping extension and the contact surface of the contact element. The ladder terminal extension serves to improve the function of the cross-sectional surface of a clamping limb in the clamping opening of conventional clamping springs. For example, in the case of a conductor having a plurality of flexible conductor cores, such as a stranded wire, this conductor terminal extension causes the conductor core profile to be pressed flat, thereby increasing the electrical contact surface and consequently reducing the ohmic resistance of the contact resistance, among other things.

Compared to the aforementioned prior art, it is an object of the invention to produce an improved clamping spring for a screwless connection terminal, which both improves the transmission of the current further and is mechanically more stable and is also simple to manufacture.

SUMMARY

The object of the present invention is achieved by the features of claim 1 and expediently designed and further developed by the features of the dependent claims.

The clamping spring according to the invention for a screwless connection terminal is initially designed according to the prior art mentioned at the outset such that the clamping spring has a clamping limb, a contact limb, and a tensioning limb. The tensioning limb is connected both to the clamping limb and to the contact limb, the clamping limb and the contact limb intersecting one another. This intersection is designed in such a way that the clamping limb has a clamping opening through which the contact limb extends. As a result, the contact limb is in contact with an edge of the clamping opening that is remote from the tensioning limb in a pretensioned manner, so that an exposed wire end of the conductor to be connected can be clamped to a contact surface of a contact element of a screwless connection terminal with the aid of the contact limb. The clamping spring according to the invention comprises a clamping extension having a clamping surface, similar to the prior art mentioned at the outset. However, the clamping extension according to the invention is completely different and more advantageous than the prior art. The clamping extension starts from the free end of the clamping limb remote from the tensioning limb, and initially extends away from the tensioning limb, then extends back, however, in the direction of the tensioning limb in a substantially curved form, and finally is only then oriented in the direction of the contact limb.

Such a configuration of the clamping extension of the clamping spring has the advantage over the prior art mentioned at the outset, among other things, that the exposed wire end of an electrical conductor can be clamped with the clamping spring according to the invention through better distribution of the pressure on the exposed wire end more effectively, in particular in a significantly more stable and efficient manner. In contrast to the prior art, in which a single pressure region is formed with a larger pressurized surface, i.e. the clamping surface of the clamping extension, the clamping spring according to the invention is equipped with two pressure regions. The first pressure region is located on the edge of the clamping opening of the clamping limb, in which the exposed wire end is clamped, i.e. the pressure exerted as a result of the clamping takes place on a small surface. The advantage in this case is that the small, pressurized surface can cut deeper into the strands and in particular in the case of a wire end sleeve arranged on the exposed wire end of the conductor in corresponding notches, so that the exposed wire end is clamped particularly strongly at this point, a very high tensile strength is given in the direction of insertion of the conductor or along the conductor and an unintentional release from the clamped position is almost impossible. Since the small, pressurized surface is designed to be comparable to a knife blade due to its small cross section and its resulting incisive effect, it is referred to below as the knife edge. Another resulting advantage of the knife edge formed on the edge of the clamping opening is that the knife edge relieves the main strain on the pull-out forces of the clamping spring due to its strong clamping force and its correspondingly provided high tensile strength. The second pressure region is located at the free end of the clamping extension, i.e. in the region of the clamping extension that adjoins the curved region of the clamping extension and is oriented substantially in the direction of the contact limb, and is referred to below as the clamping surface. The exposed wire ends of a conductor and in particular the strands or fine wires are pressed flat onto a contact surface of a contact element by means of the clamping surface of the clamping extension. Due to the large clamping surface of the clamping extension, the contact surface stressed by the exposed wire ends comes into contact with almost the entire usable electrical contact surface of the contact element, so that the transmission of the current between the exposed wire end of the conductor and the contact surface of the contact element is significantly improved compared to a smaller outer surface, because larger electrical contact surfaces are created with low electrical losses. The clamping spring according to the invention with a combination of the two pressure regions described above, i.e. the knife edge formed on the edge of the clamping opening and the clamping surface of the clamping extension, results in a fast, secure, and controlled electrical and mechanical connection to a conductor. In particular, it simultaneously allows for an improved transmission of the current over a large surface due to the second pressure region in the form of the clamping surface of the clamping extension as well as a stronger clamping effect with high tensile strength in the direction of insertion of the conductor or along the conductor, in particular in the case of a wire end sleeve attached to the exposed wire end, and consequently a main strain relief for the pull-out forces of the clamping spring, caused by the first pressure region designed as a knife edge. In contrast to a clamping spring having a clamping extension according to the prior art, on which only one pressure region is formed, the clamping spring according to the invention is therefore particularly further developed as a result of the two pressure regions, so that it is pronounced from the outset for both good transmission of the current and for a high tensile strength in the direction of insertion of the conductor or along the conductor. In addition, the combination of the two pressure regions ensures that the exposed wire end does not bend when it is inserted into the clamping opening, as is possible in the case of only one pressure region since the two pressure regions discussed above simultaneously ensure clamping of the exposed wire end.

In addition, the inventive design of the clamping extension of the clamping spring is, on the one hand, much simpler and more cost-effective to manufacture compared to the prior art mentioned at the outset, in that the clamping extension extends directly from the free end of the clamping limb remote from the tensioning limb, in particular in the case of an integral design of clamping limb and clamping extension, and is, on the other hand, mechanically more stable. In the prior art mentioned at the outset, the clamping extension is formed from a section of the clamping limb, namely from the clamping opening stamped out of the clamping limb, either by bending a section of the clamping limb that is separated out in favor of the clamping opening but still connected to the clamping limb on one side into a position parallel to the contact limb, or by completely stamping out this section and then attaching it to the clamping limb. According to EP 2 442 403 A1, a clamping extension produced in this way is designed as a clamping plate or sheet metal flag. In contrast to this, the clamping extension of the clamping spring according to the invention is not formed from an initially inner section of the clamping limb, but can be viewed as an extension of the clamping limb, so to speak. The clamping extension of the clamping spring according to the invention can thus have a larger cross-sectional surface compared to EP 2 442 403 A1, comparable to the clamping limb, and thus it can be designed to be more solid and mechanically stable.

In one embodiment of the present invention, the clamping extension, starting from the free end of the first limb remote from the tensioning limb, is initially formed substantially semicircular having a curvature pointing away from the tensioning limb, before it then merges in an arc shape into a region in which the clamping extension is aligned substantially parallel to the contact limb.

In a further embodiment of the present invention, the clamping extension is integrally formed on the clamping limb. An integral design of the clamping limb and the clamping extension is mechanically very stable. In addition, the integral design of the clamping limb and the clamping extension eliminates the need for further processing steps such as screwing, soldering, or joining, so that such a clamping extension can also be produced more quickly and thus more cost-effectively.

In a further embodiment of the present invention, the clamping extension is not formed integrally on the clamping limb, but is attached to the clamping limb by means of a joint. The joining also includes an integral joining process such as welding or soldering. Such a configuration is particularly advantageous when the clamping limb and the clamping extension are made from different materials. A metal or a material with a high electrical conductivity and a high thermal conductivity is preferably used for the production of the clamping extension.

Another embodiment of the present invention provides that the clamping extension has the same material as the clamping spring. This allows for the clamping limb and the clamping extension to be formed integrally, which is very stable from a mechanical point of view. In addition, because they are manufactured from the same material, the clamping limbs and the clamping extension also have the same material properties, such as, for example, the same electrical conductivity, the same specific resistance, and the same thermal conductivity.

According to a further embodiment of the present invention, the clamping surface of the clamping extension has at least partially a surface profiling. This surface profiling can have a surface structuring similar to that of a pincer profile, so that the conductor to be connected is in contact under improved frictional engagement. As a result, on the one hand, the electrical contact resistance and the heat transfer resistance are further reduced by pressing these surface structures into the wire ends of the conductor. On the other hand, a particularly effective mechanical connection with high tensile strengths between the wire ends of the conductor and the clamping extension is also achieved in the second pressure region of the clamping spring. Thus, the wire ends of the conductor are not only clamped with a high tensile strength in the first pressure region formed as a knife edge between the edge of the clamping opening that is remote with respect to the tensioning limb and the contact surface of a contact element, but are additionally pressed against the contact surface of a contact element with the help of its profiled clamping surface with a high tensile strength with the help of the surface profiling of the clamping extension.

In a further embodiment of the present invention, the clamping spring and/or the clamping extension is designed as a whole as a single stamped and bent part. The clamping spring according to the invention used to connect the conductor to a contact element is produced from a suitable electrically conductive material, usually from metal, in a stamping and bending method. In order to obtain a clamping spring according to the invention with a corresponding shape, an additional method step is used during the manufacturing process of the clamping spring, in which a stamping and bending method is preferably also used. The clamping extension is formed directly from an end portion of the clamping limb of the clamping spring which is significantly longer than conventional clamping limbs of clamping springs, by bending and aligning this elongated end portion in such a way that the elongated end portion of the clamping limb according to the present invention initially extends away from the tensioning limb, then extends back in a substantially curved shape in the direction of the tensioning limb, and finally extends in the direction of the contact limb or, in the assembled state on a contact element, is aligned substantially parallel to the contact surface of the contact element.

In addition to the clamping spring according to the invention per se, the present invention also comprises a screwless connection terminal for connecting an electrical conductor to the clamping spring according to the invention according to any of the embodiments described above. In addition to the clamping spring according to the invention, the screwless connection terminal also has a contact element to which the conductor is to be electrically connected and which has a connection portion and a contact surface. The conductor to be connected is clamped between a surface portion of the clamping surface of the clamping extension of the clamping spring and the contact surface of the contact element. Such a screwless connection terminal has the same advantages over the prior art as is the case for the clamping spring according to the invention.

In one embodiment of the screwless connection terminal according to the invention, the clamping surface of the clamping extension and/or the contact surface of the contact element has at least partially a surface profiling. As already described, this surface profiling can have a surface structuring similar to that of a pincer profile, with the result that the conductor to be connected is in contact under improved frictional engagement. Instead of a surface profiling of the clamping surface of the clamping extension, the contact surface of the contact element can also have a surface profile and lead to the same advantages as already explained with regard to a surface profiling of the clamping surface of the clamping extension. A surface profiling of the contact surface of the contact element in addition to a surface profiling of the clamping surface of the clamping extension ensures even more improved frictional engagement when the conductor is in contact since the outer surface of the conductor, which is clamped with a surface-profiled clamping surface, is larger in this case. This creates a particularly effective mechanical connection with very high tensile strengths between the wire ends of the conductor and the clamping extension and the contact element.

In addition, the present invention also includes an electrical plug connection which has at least one screwless connection terminal according to the invention, as mentioned above, having a clamping spring according to the invention. An electrical plug connection having a connection terminal according to the invention and in particular having a clamping spring according to the invention has the same advantages over the prior art as is the case for the clamping spring according to the invention.

BRIEF DESCRIPTION OF THE DRAWINGS

Further advantages, features, and possible applications of the present invention will become clear from the following description of embodiments thereof and the associated drawings.

DETAILED DESCRIPTION

Figure 1A:
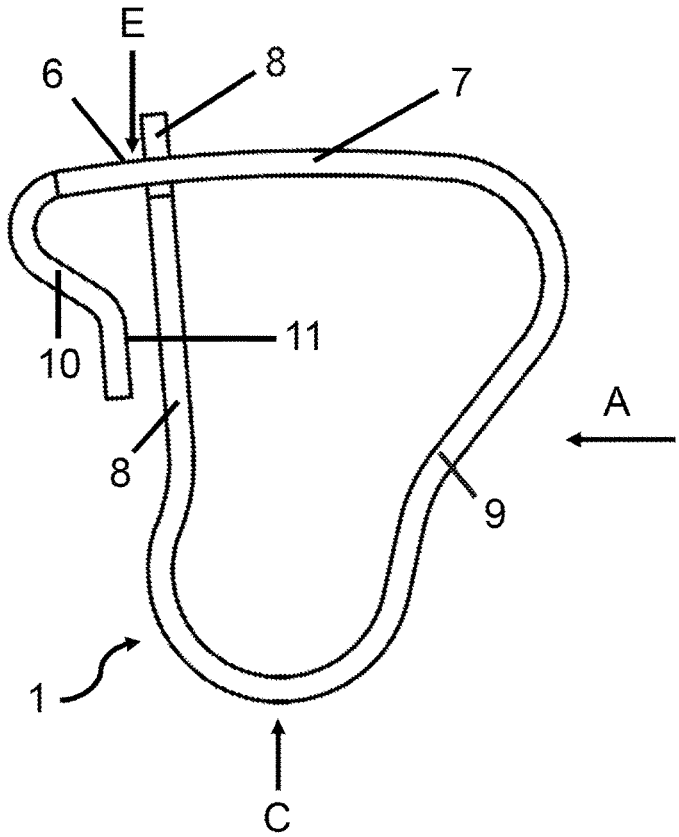
FIG. 1A to 1D: show an embodiment of a clamping spring in the profile view (FIG. 1A), in a view from below in the direction of arrow C onto the clamping spring (FIG. 1B), in a side view in the direction of arrow A onto the clamping spring according to FIG. 1A, and in perspective (FIG. 1D)
Figure 1B:
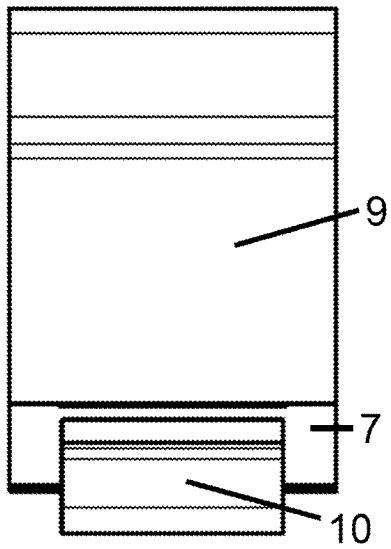
Figure 1C:
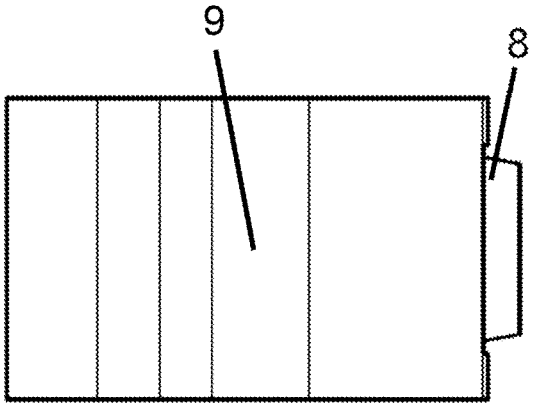
Figure 1D:
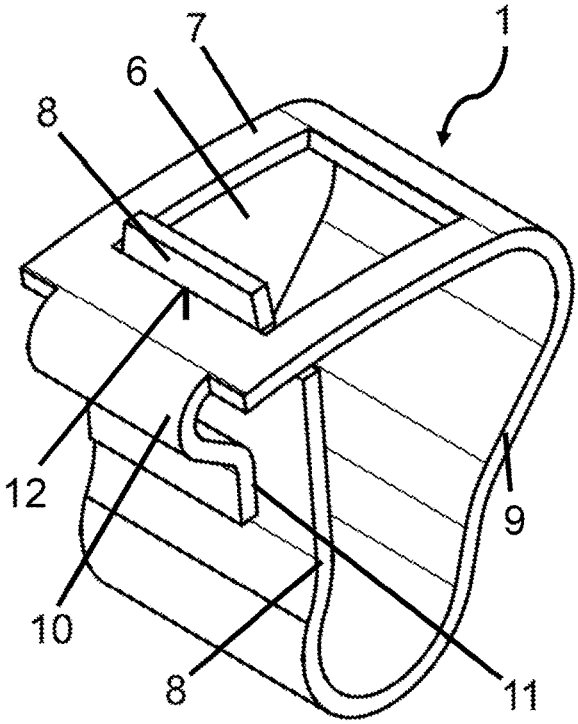

FIG. 1A to 1D show an embodiment of a bent clamping spring 1 in a profile view (FIG. 1A), in a view from below in the direction of arrow C onto the clamping spring (FIG. 1B), in a view in the direction of arrow A onto the clamping spring 1 according to FIG. 1A, and in perspective (FIG. 1D), wherein the clamping spring 1 in the illustrated preferred embodiment is designed as a cage tension spring 1, is preferably made of metal, and has a clamping limb 7, a contact limb 8 and a tensioning limb 9. The clamping limb 7 and the contact limb 8 are connected to one another via the tensioning limb 9, as shown in FIGS. 1A and 1D. A clamping opening 6 is recessed in the clamping limb 7 of the cage tension spring 1 (FIG. 1D), which allows for the intersection between the clamping limb 7 and the contact limb 8. Through the clamping opening 6 of the cage tension spring 1, the exposed wire ends 2*a* of a conductor 2, which, however, is not shown in FIG. 1A to 1D, can be introduced in the insertion direction E shown in FIG. 1A. The exposed wire ends 2*a* of a conductor 2 inserted into the clamping opening 6 are then in contact with the edge of the clamping opening 6 that is remote with respect to the tensioning limb 9, which represents a first pressure region with a small cross section and, due to its incisive effect, acts as a knife edge 12 in the exposed wire ends 2*a* (FIG. 1D). The clamping limb 7 also has a clamping extension 10 with a clamping surface 11, the clamping surface 11 forming a second flat pressure region. In the embodiment shown, the clamping extension 10 is integrally formed on the clamping limb 7, has the same material as the clamping limb 7, and can be viewed as an extension of the clamping limb 7. As shown in FIGS. 1A and 1D, said clamping extension 10 starts from the free end of the clamping limb 7 remote from the tensioning limb 9 and extends initially away from the tensioning limb 9 so as to extend back again in the direction of the tensioning limb 9 in a substantially curved form, and finally is oriented extending in the direction of the contact limb 8. In a further embodiment, the substantially curved shape of the clamping extension is semicircular. The clamping surface 11 of the clamping extension 10 is always oriented substantially parallel to the surface of the contact limb 8 and thus extends in the insertion direction E of a conductor 2 to be electrically connected (not shown in FIG. 1A to 1D).

Figure 2A:
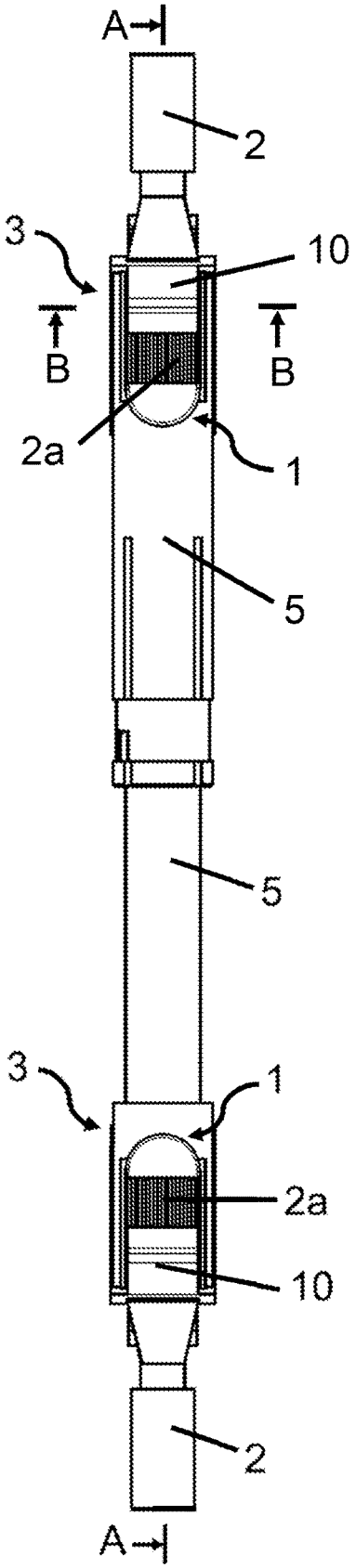
FIG. 2A to 2D: show a contact element designed as a contact sleeve and a contact pin, each having a clamping spring according to FIG. 1A to 1D, which are mechanically inserted into one another and electrically connected, in the profile view, longitudinal section view, in perspective, and cross section view.
Figure 2B:
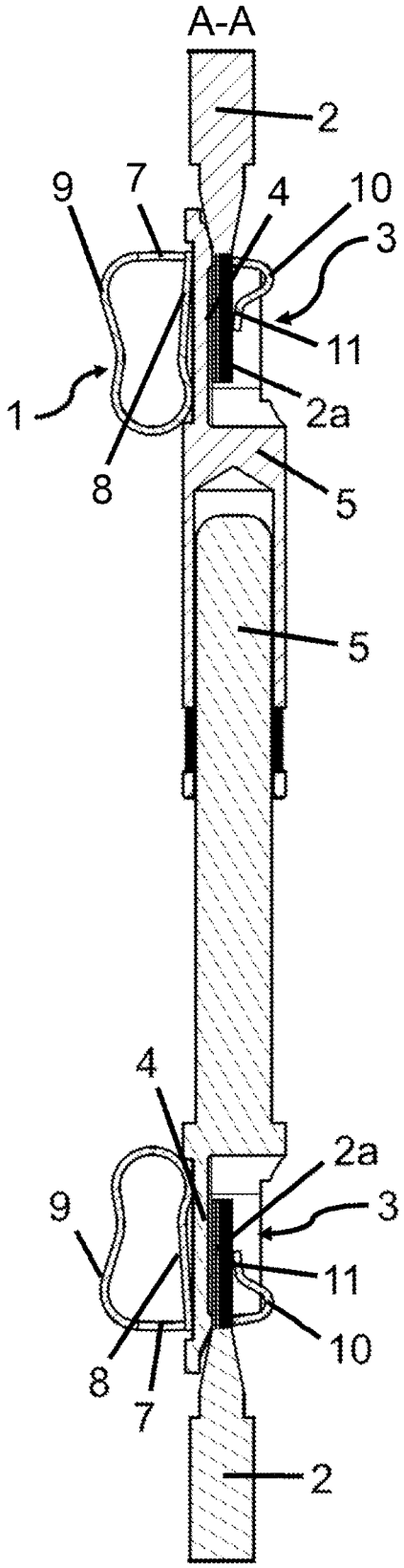
Figure 2C:
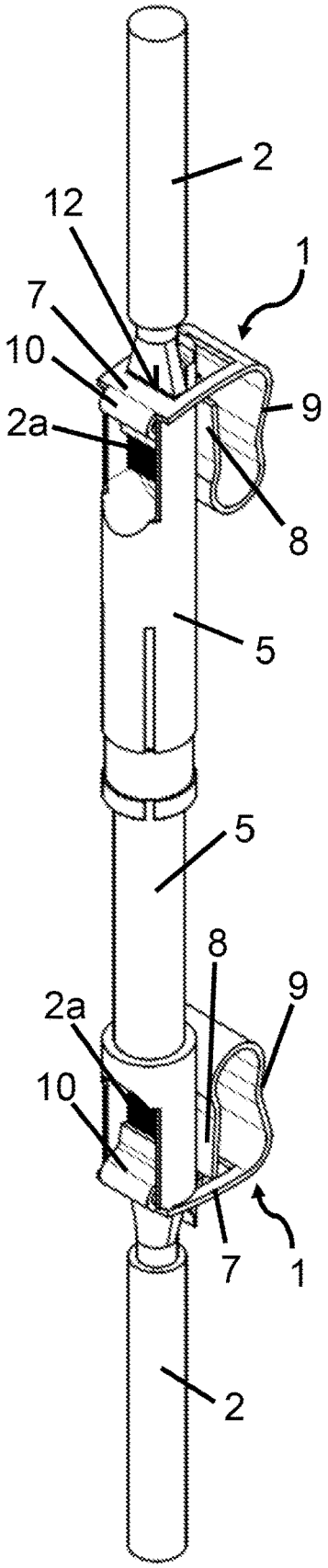
Figure 2D:
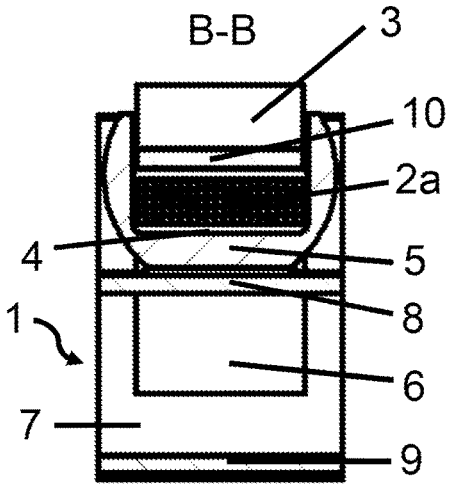

FIG. 2A to 2D represent a clamping spring 1 according to one embodiment of the invention attached to a screwless connection element, in this case designed as a cage tension spring 1 according to FIG. 1A to 1D having a clamping limb 7, a contact limb 8, and a tensioning limb 9, each having a contact element 5 in the form of a contact pin 5 and a contact sleeve or socket 5, which are mechanically inserted into one another and electrically connected. Both the contact pin 5 and the contact sleeve 5 each have a connection portion 3 having a contact surface 4, which are electrically connected to a conductor 2 by means of its exposed wire ends 2*a*. FIG. 2B shows a longitudinal section of the arrangement shown in FIG. 2A, FIG. 2C shows a perspective view, and FIG. 2D shows a cross section. The exposed wire ends 2*a* of the conductor 2 are on the one hand pressed flatly onto the contact surfaces 4 of the respective contact elements 5 by means of the clamping surface 11 of the clamping extension 10, as shown in FIG. 2B. Due to the large clamping surface 11 of the clamping extension 10, the contact surface stressed by the exposed wire ends 2*a* comes into contact with almost the entire usable electrical contact surface 4 of the respective contact element 5 (FIG. 2D). This results in a very good transmission of the current between the exposed wire end 2*a* of the conductor 2 and the contact surface 4 of the respective contact element 5, since larger electrical contact surfaces having low electrical losses are created. On the other hand, the exposed wire ends 2*a* of the conductor 2 are clamped by means of the clamping extension 10 between the edge of the clamping opening 6 of the clamping limb 7 and the contact surface 4 of the respective contact element 5, which is remote in relation to the tensioning limb 9 and formed as a knife edge 12, in that the clamping extension 10 exerts pressure on the edge of the clamping opening 6 of the clamping limb 7, which is remote in relation to the tensioning limb 9 and is formed as a knife edge 12 (FIG. 2C). The small pressurized surface at the edge of the clamping opening 6, which is referred to as the knife edge 12 due to its small cross section and its resulting incisive effect, can cut deeper into the strands and in the case of a wire end sleeve arranged on the exposed wire end 2*a* of the conductor 2 can cut into corresponding notches, so that the exposed wire end 2*a* is clamped particularly strongly, a high tensile strength is given in the insertion direction E of the conductor 2, and consequently an unintentional release from the clamped position in the insertion direction E of the conductor 2 is not possible. In addition, because of its strong clamping force and its correspondingly provided high tensile strength, the knife edge 12 relieves the main strain on the pull-out forces of the clamping spring 1. The presence of two pressurized surfaces, namely the clamping surface 11 of the clamping extension 10 and the knife edge 12 at the edge of the clamping opening 6, with which the electrical contact is ensured between the exposed wire ends 2*a* of a conductor 2 and the contact surface 4 of the respective contact element 5, ensures, in addition to the advantages already mentioned, that the exposed wire end 2*a* of the conductor 2 does not bend when it is inserted into the clamping opening 6, since the two pressurized surfaces discussed above simultaneously ensure that the exposed wire end 2*a* is clamped. Furthermore, the simultaneous clamping of the exposed wire end 2*a* on two pressurized surfaces has the advantage that with one and the same clamping spring 1 both a good transmission of the current and a high tensile strength in the insertion direction E of the conductor 2 with simultaneous main strain relief through the knife edge 12 is made possible, while a clamping extension 10 according to the prior art with only one formed pressure region can be designed either for a good transmission of the current or for a high tensile strength in the insertion direction E of the conductor 2.

Figure 3A:
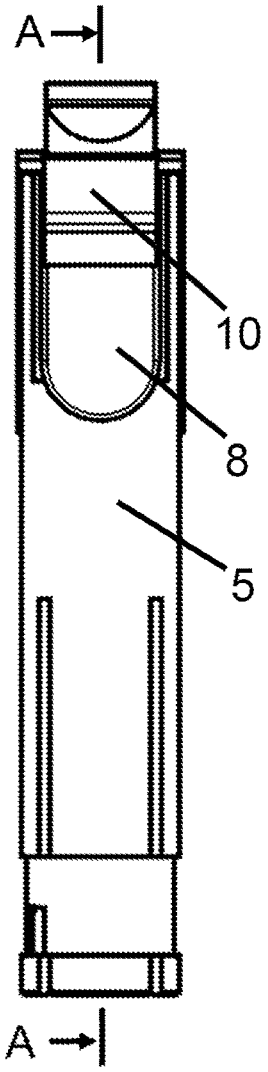
FIG. 3A to 3D: show a contact sleeve as a contact element having a clamping spring according to FIG. 1A to 1D in profile view, side view, top view, and in perspective.
Figure 3B:
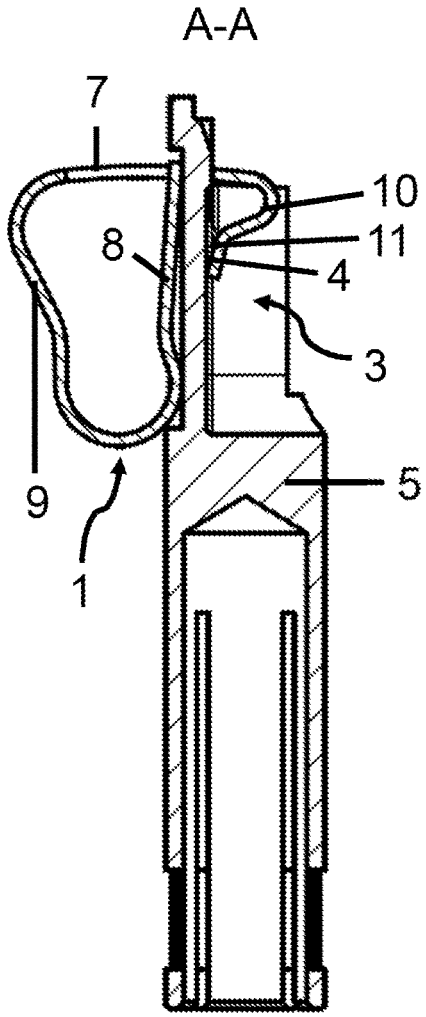
Figure 3C:
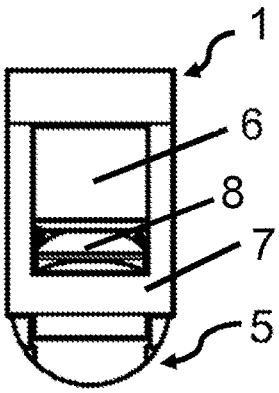
Figure 3D:
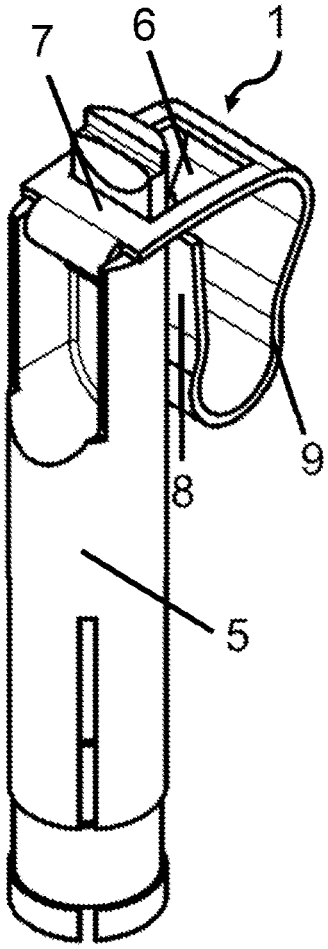
Figure 4A:
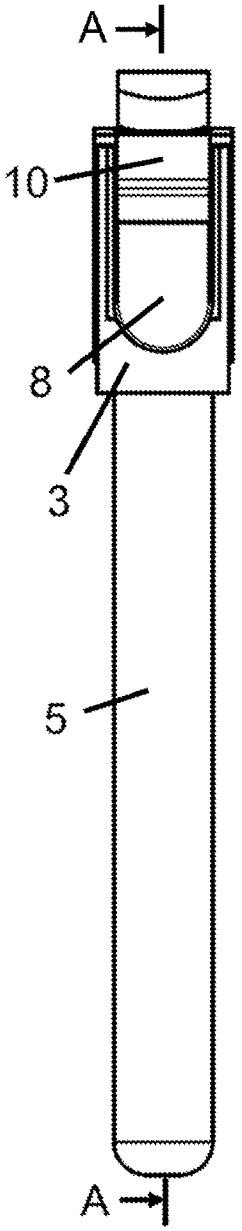
FIG. 4A to 4D: show a contact pin as a contact element having a clamping spring according to FIG. 1A to 1D in profile view, side view, top view, and in perspective.
Figure 4B:
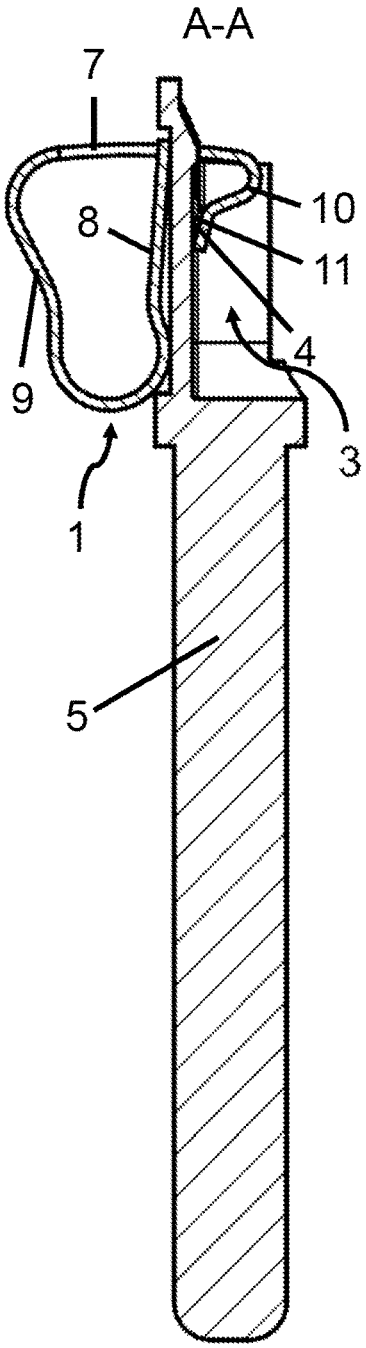
Figure 4C:
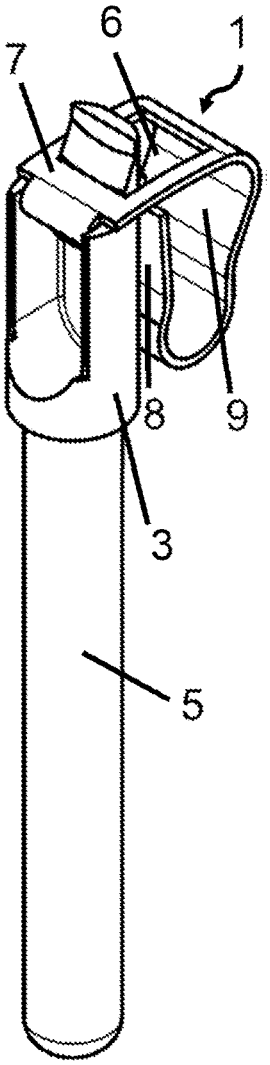
Figure 4D:
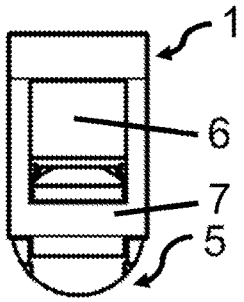

FIG. 3A to 3D and FIG. 4A to 4D show in each case an embodiment of a clamping spring 1 attached to a screwless connection element, which is designed as a cage tension spring 1 having a clamping limb 7, a contact limb 8, and a tensioning limb 9 according to FIG. 1A to 1D, having a contact element 5 designed as a contact sleeve 5 in the case of FIG. 3A to 3D and as a contact pin 5 in the case of FIG. 4A to 4D. FIGS. 3B and 4B each show a longitudinal section of the arrangement shown in the corresponding FIGS. 3A and 4A, FIGS. 3C and 4C show a perspective view, and FIGS. 3D and 4D show a cross section. The cage tension spring 1 is in each case mounted in a pretensioned manner on the contact element 5. When assembling the cage tension spring 1, the protruding section of the connection element 3 of the contact sleeve 5 (FIG. 3A to 3C) or the contact pin 5 (FIG. 4A to 4C) are introduced through the clamping opening 6 in such a way that the protruding section of the connection element 3 is at least partially in contact with the contact limb 8 of the cage tension spring 1 and the clamping extension 10 is also in contact with its clamping surface 11 on the protruding section of the connection element 3 if no conductor has yet been inserted. In addition, the clamping limb 7 of the clamping spring 1 is in contact with the end face of the contact element 1. This creates a force-fit connection and fixation of the cage tension spring 1 on the contact element 5.

Attention is drawn to the fact that all features that are apparent to a person skilled in the art from the present description, and the drawings, even if these features were only described in connection with certain further features, can be combined both individually and in any desired combinations with other features or groups of features disclosed in the present invention, unless this has been explicitly excluded or technical circumstances make such combinations impossible or meaningless. For the sake of brevity and legibility of the description, a comprehensive, express description of all possible combinations of features has been avoided. The scope of protection of the present invention defined by the claims is not restricted by the embodiments of the invention which are shown in detail in the description and the drawings and are only used by way of example. Modifications of the disclosed embodiments will be apparent to a person skilled in the art from the drawings, the description, and the accompanying claims. The word "having" cited in the claims does not exclude other elements or steps. The indefinite article "a" or "an" does not exclude a plurality. The combination of features that are claimed in different claims is not excluded.

LIST OF REFERENCE SIGNS

1 Clamping spring
2 Electrical conductor
2*a* Exposed wire end of an electrical conductor
3 Connection portion
4 Contact surface
5 Contact element
6 Clamping opening
7 Clamping limb
8 Contact limb
9 Tensioning limb
10 Clamping extension
11 Clamping surface
12 Knife edge
E Direction of insertion

The invention claimed is:

1. A clamping spring for a screwless connection terminal for connecting a conductor, wherein the clamping spring has a clamping limb, a contact limb, and a tensioning limb, the tensioning limb being connected to the clamping limb and the contact limb, and the clamping limb and the contact limb being designed as intersecting limbs, wherein the clamping limb has a clamping opening through which the contact limb extends, such that the contact limb is in contact with an edge of the clamping opening remote from the tensioning limb in a pretensioned manner and an exposed wire end of a conductor can be clamped with the contact limb onto a contact surface of a contact element of a screwless connection terminal, wherein the clamping limb has a clamping extension having a clamping surface, characterized in that:

said clamping extension, starting from the free end of the clamping limb remote from the tensioning limb, initially being formed so as to extend away from the tensioning limb, being then formed so as to extend back in the direction of the tensioning limb in a substantially curved form, and finally being oriented in the direction of the contact limb.

2. The clamping spring according to claim 1, characterized in that the clamping extension, starting from the free end of the clamping limb remote from the tensioning limb, is initially formed substantially semicircular having a curvature pointing away from the tensioning limb and is then aligned in an arcuate transition substantially parallel to the contact limb.

3. The clamping spring according to either claim 1, characterized in that the clamping extension is integrally formed on the clamping limb.

4. The clamping spring according to either claim 1, characterized in that the clamping extension is attached to the clamping limb by means of a joining process, wherein the joining can also be an integral joining process such as welding or soldering.

5. The clamping spring according to claim 1, characterized in that the clamping extension has the same material as the clamping spring.

6. The clamping spring according to claim 1, characterized in that the clamping surface of the clamping extension at least partially has a surface profiling.

7. The clamping spring according to claim 1, characterized in that the clamping spring and/or the clamping extension is designed as a whole as a single stamped and bent part.

8. The clamping spring according to claim 1, characterized in that the clamping surface forms a flat pressure region and/or in that the exposed wire end of the conductor can be pressed by means of the clamping surface of the clamping extension flat onto the contact surface of the contact element.

9. A screwless connection terminal for connecting an electrical conductor with a clamping spring according to claim 1, wherein the connection terminal has a contact element to which the conductor is to be electrically connected and which has a connection portion and a contact surface, wherein the conductor to be connected is to be clamped between a surface portion of the clamping surface of the clamping extension and the contact surface of the contact element.

10. The screwless connection terminal according to claim 9, characterized in that the clamping surface of the clamping extension and/or the contact surface of the contact element at least partially has a surface profiling.

11. An electrical plug connection, characterized in that it comprises at least one screwless connection terminal according to claim 9.

* * * * *